United States Patent [19]

LeBoeuf et al.

[11] Patent Number: 4,955,554

[45] Date of Patent: Sep. 11, 1990

[54] FILM WINDER

[75] Inventors: William E. LeBoeuf; H. V. Wait, Jr., both of Midland, Mich.

[73] Assignee: The Dow Chemical Company, Midland, Mich.

[21] Appl. No.: 242,590

[22] Filed: Sep. 12, 1988

[51] Int. Cl.[5] ..... B65H 18/16

[52] U.S. Cl. ..... 242/65; 242/66

[58] Field of Search ..... 242/56 R, 56 A, 65, 242/66, 75.2, 18 A

[56] References Cited

U.S. PATENT DOCUMENTS

| | | | |
|---|---|---|---|
| 1,739,931 | 12/1929 | Valentine | 242/66 |
| 1,967,922 | 7/1934 | Cameron | 242/66 |
| 3,355,117 | 11/1967 | Gerhardt et al. | 242/18 A |
| 4,105,170 | 8/1978 | Schönmeier | 242/65 |
| 4,171,780 | 10/1979 | Bugnone | 242/56 A |
| 4,265,409 | 5/1981 | Cox et al. | 242/56 A |

FOREIGN PATENT DOCUMENTS

| | | | |
|---|---|---|---|
| 805676 | 11/1936 | France | 242/66 |
| 0141476 | 11/1979 | Japan | 242/56 B |

*Primary Examiner*—Daniel P. Stodola
*Assistant Examiner*—Paul T. Bowen

[57] ABSTRACT

A film winder apparatus and method to minimize wrinkles during film winding comprising provision of balancing and counterbalancing mechanisms so that forces involved when cores are engaged by a bed roll occurring during film winding are effectively minimized while allowing the core to be in intimate contact with the bed roll.

10 Claims, 1 Drawing Sheet

FILM WINDER

BACKGROUND OF THE INVENTION

The present invention relates generally to the field of film winding. More particularly the invention relates to taking a flat film and winding it upon a hollow core so that the film wound on the core is essentially flat. The method and apparatus of this invention is directed towards steps and mechanism to achieve a high degree of flatness of the film rolled on the core by allowing the core to be in especially close proximity to a bed roll from which it receives the film.

Multiple web winders for films, which winders wind more than one web in the same web path, have traditionally had to compromise film flatness because of the physical limitations of the winder apparatus. Ideally the film being wound is placed up against a bed roll and is kept in close tolerance to the bed roll to have an essentially wrinkle free film. In order to accomplish this result most effectively, the bed roll would have to run against the film surface being wound upon the core. However, it is difficult to control the forces between the bed roll and the core in such a way as to minimize compression of the wound film. None of the prior art technology teaches how to sufficiently balance the forces of the core to the bed roll, nor to adjust for the fact that a core changes diameter as it is being wound with the film. Also a factor in multiple web winders is that there is customarily a plurality of mandrels in the winder system and the rolls of more than one mandrel may be touching the bed roll at any given moment, each exerting a different pressure with respect to the bed roll. Because of these factors, prior art winders of multiple webs have allowed the cores to be spaced a distance from the bed roll. This is to compensate for the constantly varying core diameter as it is having film wound upon it and to allow automatic core feeding and removal. The result has been that films which are wound upon such a core customarily have a surface which is wrinkled to the degree that it is highly noticed by the consumer, a wound roll diameter which is unnecessarily large, and other undesirable attributes.

An answer to obtaining a high degree of film flatness with the use of a plastic film winder has been found in sufficiently and automatically counterbalancing the relative forces between the bed roll and the core as the core is being wound and its diameter constantly changing so that close contact between bed roll and the core upon which the film is being wound is maintained even when more than one core is in proximity to the bed roll. The present invention provides such a solution.

BRIEF DESCRIPTION OF THE INVENTION

In the arrangement of the film winder of the present invention a turret mechanism carries a plurality of core support mandrels which successively move into proximity with the bed roll to pick up film coming off of the bed roll to be wrapped on a core carried by the mandrels. The turret support is pivotal about a point so that the core wrapped on each mandrel pushes against the bed roll as it engages the bed roll and travels along the circumferential surface of the bed roll while picking up film being wound upon the core. The force of the core against the bed roll and the counteracting force of the bed roll against the core carried by the mandrel is balanced by a mechanism which acts through a turret lever arm extending from the pivot point and fixedly secured to the turret. The turret lever arm is connected linearly to a ratio multiplier pulley which itself is linearly connected to a turret balancing cam. Movement of the arm is controlled by the movement of the turret lever arm as each core on a mandrel engages the bed roll and is counterbalanced by either a counterweight or equivalent component. The linear relationship between the ratio multiplying pulley and the turret balancing cam varies as the lever arm moves because of the cam surface of the turret balancing cam. The radius from a pivot point of the cam to the linear element, which can be a cable, results in an automatic adjustment of the forces between the core containing mandrels as it engages the bed roll of the winder.

The action of the turret balancing cam together with the counterweight, the ratio multiplying pulley and the action of the turret lever arm permit the turret support element to respond through mechanical mechanisms as each core on a mandrel engages the bed roll so that the amount of forces between the core and the mandrels and a bed roll are just sufficient to permit close contact between the core and the bed roll as the film is being wound. This provides exceedingly flat film on the finished wrapped core.

DETAILED DESCRIPTION OF THE INVENTION

Figure 1:
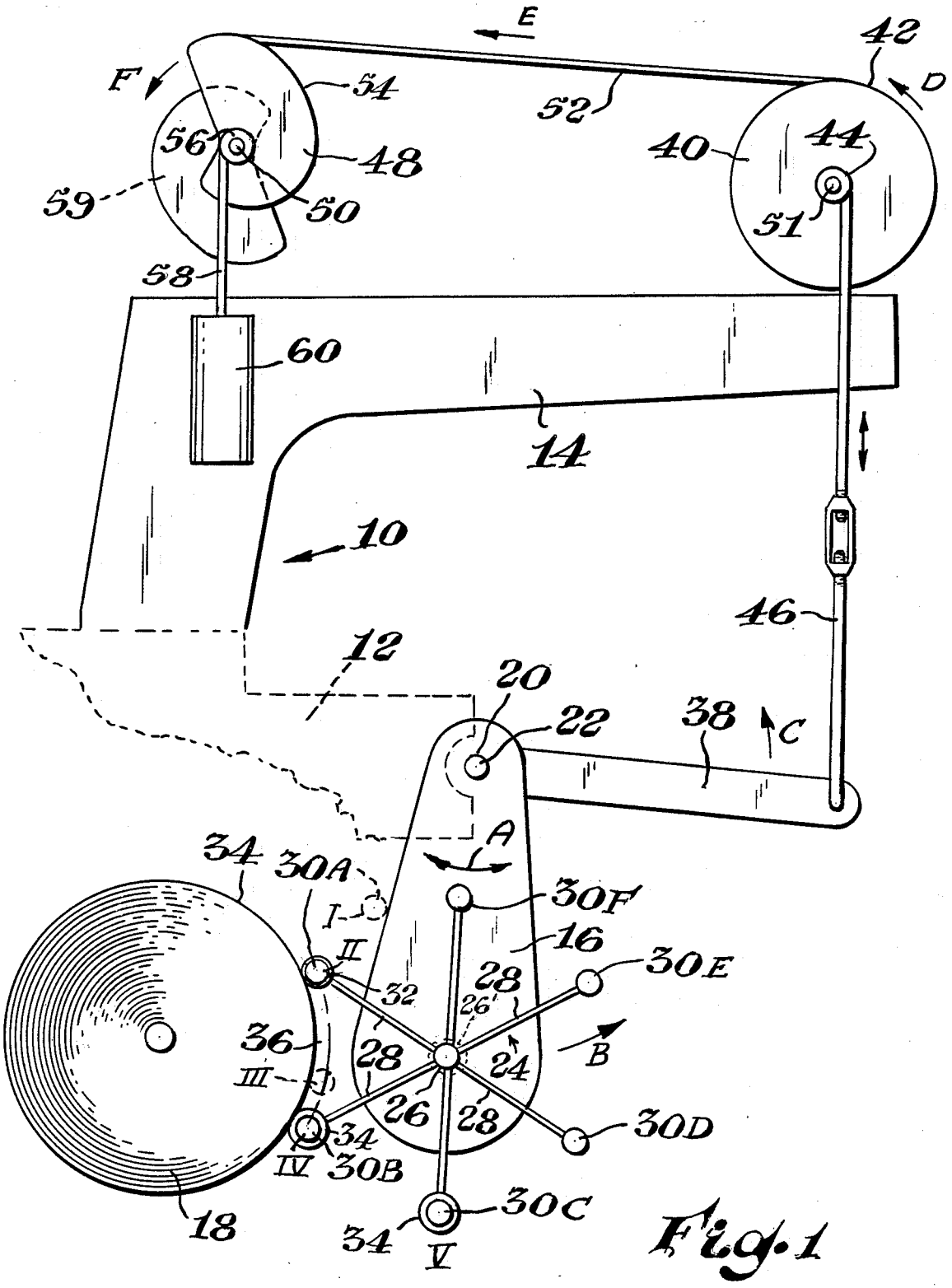
FIGURE 1 is a schematic elevational view of the apparatus of the present invention, showing in broken lines what happens as a core upon the mandrel rotates about a turret support.

FIGURE 1 illustrates schematically a film apparatus 10 constructed according to the concepts of the present invention. FIGURE 1 is in effect a side-elevational view of one end of the apparatus, the other end being a mirror image. The basic elements of the apparatus comprise a partially broken away main frame 12 carrying a support bracket 14, a turret side support 16 and a bed roll 18. Turret 16 is supported by pivot tube 20 carried on the frame 12 so that the turret can move back and forth about the turret pivot point 22 as shown by the arrow A. Also carried by turret support 16 is a mandrel spider 24 pivoting about the turret at mandrel pivot point shaft 26, each of the mandrel spider arms 28 carrying a mandrel 30, the successive mandrels carrying the letters 30A, 30B, 30C, 30D, 30E and 30F. Each of the mandrels carry a film core 32 upon which is wrapped a film 34 coming from bed roll 18. As the mandrel passes along a winding path 36 to the position occupied by mandrel 30B the film 34 is wrapped on the core 30A to complete the desired quantity of film upon the core. The winding path 36 essentially follows the curvature of the bed roll. It has been found advantageous to have mandrel acceleration during indexing, i.e., movement of mandrel A from position I to II with an immediately following indexing pause at position III during winding. The indexing accelerates the core to the bed roll surface speed to effect winding. Such acceleration and pausing can be effected by any conventional mechanism such as a Geneava gear mechanism 26' operating turret shaft 26 shown hidden on FIGURE 1, which Geneva gear is typified by that taught in U.S. Pat. No. 2,769,600.

To obtain flat film winding it is desired to maintain the core 32 against the bed roll including the film being wound thereon or in especially close proximity thereto during a substantial portion of the winding path. However, in bringing the core and bed roll in such a proximate relationship, the core should not be resting against the bed roll with such force that the film is compressed upon the roll so as to cause the film to be difficult to separate from its many wound layers or to distort the film by high compression forces. The applicants have achieved a method for providing the desired forces which are generally in the range of about 25 lbs in a direction radially directed at the bed roll from the core carrying mandrel surface.

To achieve the proper forces, attached to the turret support directly or through pivot tube 20 is turret lever arm 38. Carried by support bracket 14 is a ratio multiplying pulley 40 having a large hub 42 and a small hub 44. Rotatable about hub 44 and fixed to arm 38 is a main turret support cable 46. Main turret support cable 46 can be made adjustable in length by a mechanism as simple as a turnbuckle or its equivalent.

Also supported by a bracket 14 by means not shown is a turret balancing cam 48 which rotates about pivot point 50 as pulley 40 rotates about its pivot point 51. A linking cable 52 traveling around the outer periphery 42 of pulley 40 also travels about outer periphery 54 of turret balancing cam 48. Suspended from a smaller inner pulley 56 by cable 58 can be a counterweight 60 or its essential equivalent. Preferably turret balancing cam 48 carries on a shaft 56 another cam 59 having a mirror image and disposed at 180° with respect to cam 48 so that a smooth vibratory-free action is obtained upon movement of the balancing cam 48 about its pivot point 50. The counterbalancing cam 59 has no function other than counterbalancing cam 48 and carries no cable.

In operation mandrel 30A after it picks up a core 32, travels first to position I, rapidly accelerates to position II to obtain the same speed as the bed roll and then picks up the film 34. It then travels along winding path 36 where there is a pause at position III so that the bed roll is in intimate contact with the film being wound upon the core during virtually the complete wind. The core with its wound film then comes off the bed roll at position IV where the film is cut. The mandrel is then taken to position V and the core with its wound film is removed from the mandrel. When the mandrel 30A reaches position II it causes the turret support 16 to move in the direction of arrow B away from the bed roll 18 which in turn causes the turret lever arm to move upwardly in the direction shown by the arrow C, which latter action is transmitted by cable 46 to the small wheel 44 of pulley multiplier 40. This in turn causes the pulley 40 to rotate about pivot point 51 in the direction of arrow D causing the linking cable 52 to move in the direction of arrow E, which in turn causes the turret balancing cam 48 to rotate in the direction of arrow F. As this operation occurs the forces delivered to the bed roll 18 by the weight of the turret support 16 and all of its components are counterbalanced and automatically adjusted so-as to obtain minimum forces while the mandrel 30A, core 32 and film 34 the core is carrying, move along the winding path 36. As the balancing cam 48 rotates, the radius from the pivot point 50 to the surface 54 of the balancing cam where it is engaged by cable 52 varies so as to compensate in proportion to the forces between the mandrel 30A and its contents as it moves from position II to position IV.

With the mechanism of this present invention varying forces are automatically compensated for and it is possible to maintain the proper clearance between the mandrel and its contents regardless of the roll size and the thickness of the film carried thereon. This results in an especially flat film which is highly desirable for the reasons heretofore stated.

Other modifications of the present invention are possible and could still be within the scope of the appending claims and it should be understood that other details and variations of the particular mechanism and its operation as taught may be possible without affecting the scope and protection herein afforded.

What is claimed is:

1. Film winding apparatus comprising a bed roll, a turret carrying indexing mandrels for containing rolls of film, means adjustably pivoting said turret such that said mandrels and their contents engage said bed roll along a winding path, adjustable means connecting said turret so that when it is rotated about its pivot forces incident thereto are transmitted to a ratio multiplying means, said ratio multiplying means being linked with a balancing cam having a varying radius, said cam carrying a counterforce mechanism whereby engagement of one of said mandrels with the bed roll transmits the incident forces to the ratio multiplier and balancing cam such that the incident forces between the bed roll and each mandrel and its contents are minimized during the operation of the winding apparatus.

2. The film winding apparatus of claim 1 wherein means is provided to accelerate said one mandrel as it approaches the bed roll yet allow the mandrel turret to pause during winding along the winding path to have cores put on other mandrels and to complete the winding operation such that the bed roll is in intimate contact with film being wound upon the core during virtually the complete wind.

3. The film winding apparatus of claim 1 wherein said counterforce mechanism includes a dead weight means.

4. The film winding apparatus of claim 3 wherein said balancing cam is carried on a shaft and a counterbalancing cam is carried on the same shaft as said balancing cam.

5. A multiple mandrel contact winding process for continuously winding film from a bed roll such that a bed roll is in intimate contact with the film being wound upon multiple cores during virtually the complete wind, said process comprising the steps of:

permitting each core sequentially to approach and engage said bed roll during winding of the film from the bed roll onto said core, counterbalancing engagement forces between the bed roll and core which forces change as the film is being wound thereupon with a mechanical weighted counterbalancing force approximately equal to and in general opposite direction to the engagement forces to maintain a substantially constant force between the bed roll and the cores.

6. The process of claim 5 wherein a dead weight means activates a counterbalancing force during the process.

7. The process of claim 6 wherein said dead weight means is carried by a line passing over a balancing cam surface, the weight and cam surfaces acting to direct counterbalancing forces through said line directly as the core and film therein are engaging said bed roll during the process.

8. The process of claim 7 wherein ratio multiplier means acts to minimize the engaging forces during the process.

9. The process of claim 8 wherein the core about to have film wound thereupon is accelerated in a winding path as it approaches said bed roll to coincide with the bed roll speed, and is allowed to pause in the winding path for winding.

10. The process of claim 8 wherein a balancing cam providing said cam surface is counterbalancing by a counterbalancing cam.

* * * * *